US005992715A

United States Patent [19]

Habibi

[11] Patent Number: 5,992,715

[45] Date of Patent: Nov. 30, 1999

[54] SPRAY BOTTLE LANYARD AND METHOD OF ATTACHMENT

[76] Inventor: Masood Habibi, P.O. Box 71104, Los Angeles, Calif. 90071

[21] Appl. No.: 09/131,000

[22] Filed: Aug. 7, 1998

[51] Int. Cl.[6] ..... A45F 5/00; B25B 5/00

[52] U.S. Cl. ..... 224/247; 224/148.1; 224/148.7; 224/257; 222/175

[58] Field of Search ..... 222/175; 224/148.1, 224/148.4, 148.5, 148.6, 247, 257, 258, 603, 148.7; 24/3.4

[56] References Cited

U.S. PATENT DOCUMENTS 2,169,080 8/1939 Clark ..... 224/247 X
4,023,712 5/1977 Babiak et al. ..... 222/175
5,890,635 4/1999 Wu et al. ..... 224/148.4

*Primary Examiner*—Robert M. Fetsuga
*Attorney, Agent, or Firm*—D'Alessandro & Ritchie

[57] ABSTRACT

A spring clip having opposed teeth is attached to a lanyard. The lanyard may be worn around a user's neck. The spring clip with opposing teeth fits around and securely grasps the seal ring at the top of a conventional pressurized spray bottle. Alternatively, a spring band fits around the seal ring of a conventional pressurized spray bottle. A lanyard attached to the spring band allows the bottle to be hung from a user's neck or other part of the body for ease of access and use. In a third aspect, a band having a high friction or adhesive inner surface is applied to the main body of a conventional cylindrical pressurized spray bottle. A lanyard attached to the band allows the bottle to be hung from a part of the user's body as before.

2 Claims, 7 Drawing Sheets

SPRAY BOTTLE LANYARD AND METHOD OF ATTACHMENT

BACKGROUND OF THE INVENTION

1. Field of the Invention

This invention relates to pressurized spray bottles. More particularly, the present invention relates to a method and apparatus for attaching a lanyard to a spray bottle so that the spray bottle may be attached to the lanyard, the lanyard worn around the neck, and the spray bottle made readily available to a user.

2. The Prior Art

Pressurized spray bottles are well known in most fields of endeavor. A typical pressurized spray bottle 10 is shown in FIG. 1. Pressurized spray bottle 10 includes a sealing ring 12 disposed about a cap 13 which is generally crimped over a lower portion or container portion 14 which contains the contents of spray bottle 10. At the center of sealing ring 12 is a discharge tube 16. In normal use, pressing on discharge tube 16 causes a valve disposed at the center of cap 13 and communicating with the inside of spray bottle 10 to open, allowing pressurized contents of spray bottle 10 to escape through discharge tube 16. A knob 18 is generally provided which fits over discharge tube 16 and facilitates the application of downward pressure to discharge tube 16. When knob 18 is attached to discharge tube 16, a diversion channel 20 within knob 18 redirects the flow of material discharged from discharge tube 16 approximately 90° toward a nozzle 22 out of which material stored in bottle 10 is emitted.

FIG. 2 shows a top view of the pressurized bottle of FIG. 1 taken along line 2—2 of FIG. 1.

FIG. 3 shows a perspective view of bottle 10, sealing ring 12 and discharge tube 16 mounted on valve 24 which is integral with cap 13.

Many applications for pressurized spray bottles require frequent manipulation of the spray bottle by a user. For example, in the hair care industry, hair stylists may use such a bottle to contain and spray hairspray. A typical use of bottles of pressurized hairspray requires one hand to manipulate the hair, another hand to manipulate a comb or brush, and no hands left to manipulate the hairspray bottle. Thus, the hairspray bottle is continuously being picked up and placed down throughout the process. A more efficient approach would be desirable.

OBJECTS AND ADVANTAGES OF THE INVENTION

Accordingly, it is an object of the present invention to provide a more efficient way of holding a pressurized spray bottle.

It is a further object and advantage of the present invention to provide a method and apparatus for securely attaching a pressurized spray bottle to a lanyard which can be worn about the neck of a user. These and many other objects and advantages of the present invention will become apparent to those of ordinary skill in the art from a consideration of the drawings and ensuing description of the invention.

SUMMARY OF THE INVENTION

In a first aspect, a spring clip having opposed teeth is attached to a lanyard. The lanyard may be worn around a user's neck. The spring clip with opposing teeth fits around and securely grasps the seal ring at the top of a conventional pressurized spray bottle. In a second aspect, a spring band fits around the seal ring of a conventional pressurized spray bottle. A lanyard attached to the spring band allows the bottle to be hung from a user's neck or other part of the body for ease of access and use. In a third aspect, a band having a high friction or adhesive inner surface is applied to the main body of a conventional cylindrical pressurized spray bottle. A lanyard attached to the band allows the bottle to be hung from a part of the user's body as before.

BRIEF DESCRIPITION OF THE DRAWINGS

DESCRIPION OF THE PREFERRED EMBODIMENTS

Figure 1:
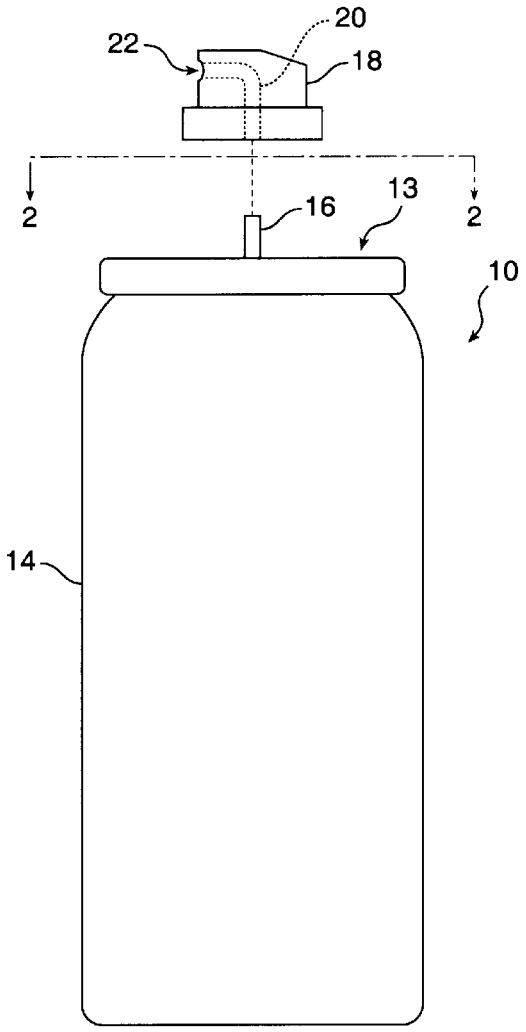
FIG. 1 (PRIOR ART)
FIG. 1 is a front elevational drawing of a pressurized spray bottle in accordance with the prior art.
Figure 2:
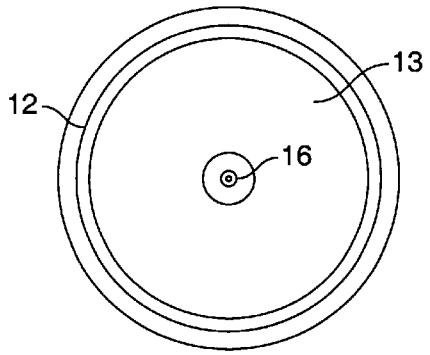
FIG. 2 (PRIOR ART)
FIG. 2 is a top view of a pressurized spray bottle in accordance with the teachings of the prior art.
Figure 3:
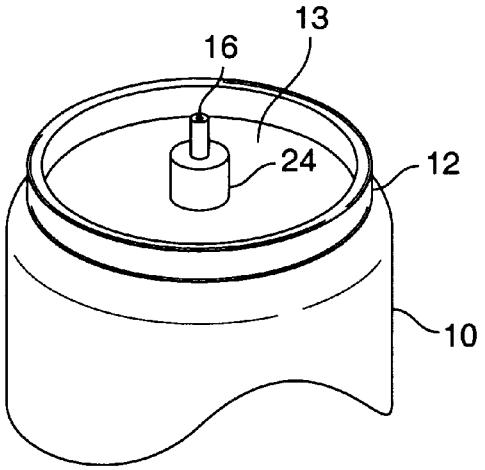
FIG. 3 (PRIOR ART)
FIG. 3 is a front perspective view of a pressurized spray bottle in accordance with the prior art.
Figure 4:
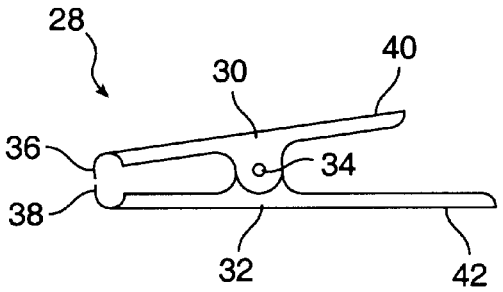
FIG. 4 is a side elevational view of a spring clip having opposing teeth.

Those of ordinary skill in the art will realize that the following description of the present invention is illustrative only and is not intended to be in any way limiting. Other embodiments of the invention will readily suggest themselves to such skilled persons from an examination of the within disclosure.

In accordance with the presently preferred embodiment of the present invention, a spring clip 28 is formed of two mutually pivoting pieces 30 and 32 which pivot about a common pivot line 34 and have opposing teeth 36 and 38 respectively. A spring or other bias mechanism 26, shown in FIG. 8, biases the spring clip 28 toward a closed position wherein opposing teeth 36 and 38 are in contact with one another. Surfaces 40 and 42 serve to provide finger operated opening levers to assist in disengaging clip 28.

Figure 5:
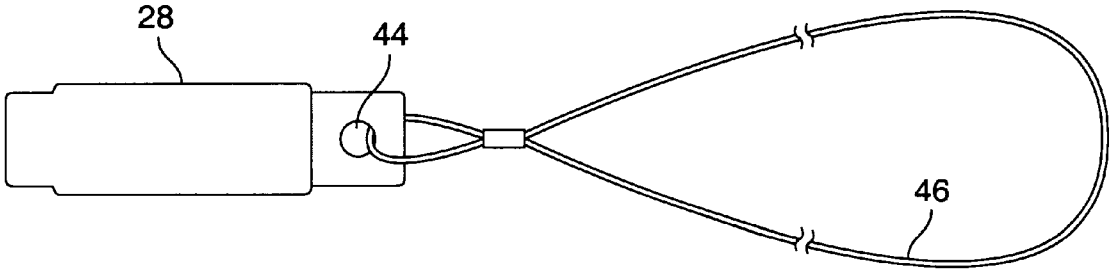
FIG. 5 is a top view of a spring clip attached to a lanyard.

As can be seen in FIG. 5, a hole 44 is provided in and through surface 42 so that a lanyard 46 may be attached thereto.

Figure 6:
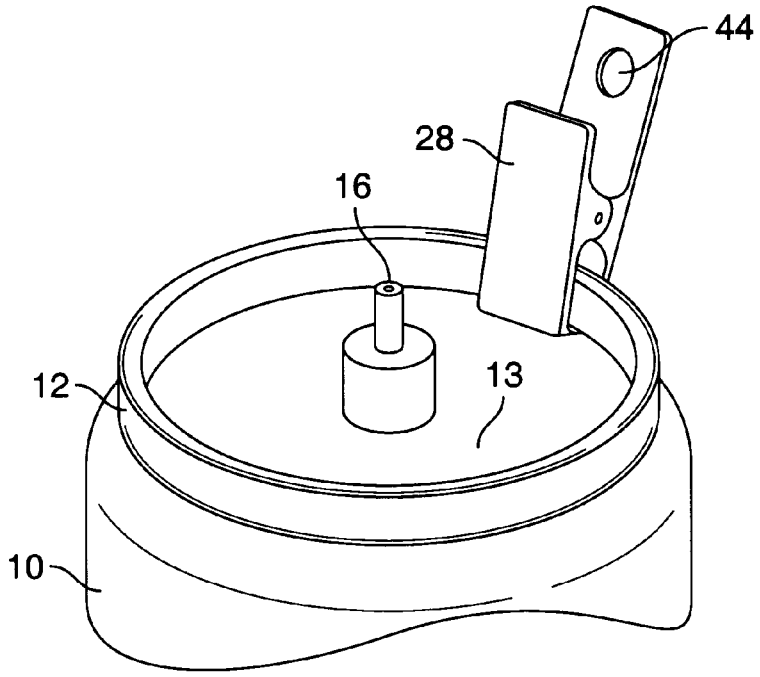
FIG. 6 is a front perspective view showing a spring clip with opposing teeth attached to the seal ring of a pressurized spray bottle.

FIG. 6 shows clip 28 fastened to sealing ring 12 as it would be in accordance with a presently preferred embodiment of the present invention. The low profile of clip 28 permits a conventional knob 18 to be installed on discharge tube 16 without experiencing significant interference with clip 28. Thus, bottle 10 may be used with clip 28 in place over sealing ring 12.

Figure 7:
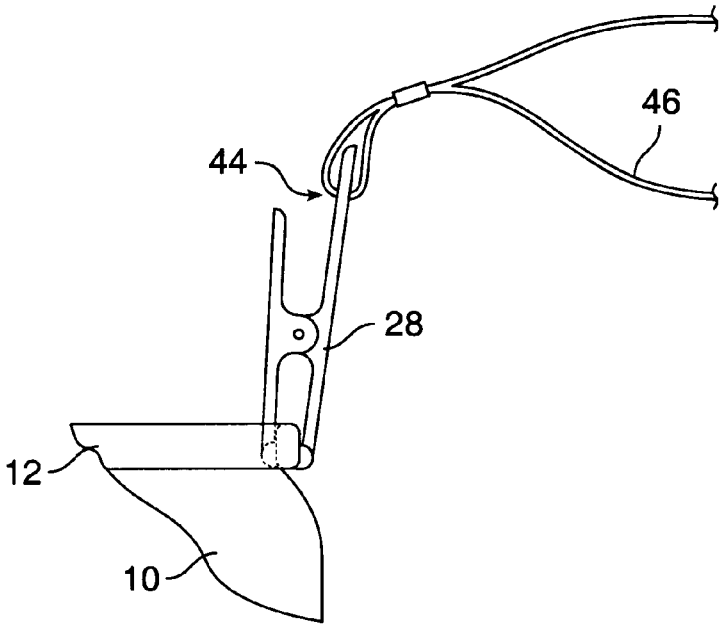
FIG. 7 is a side elevational view showing a spring clip having opposing teeth clamped to the seal ring of a pressurized spray bottle and attached to a lanyard.

FIG. 7 shows an elevational view of the clip 28 attached to sealing ring 12 and having its lanyard 46 attached at hole 44.

Figure 8:
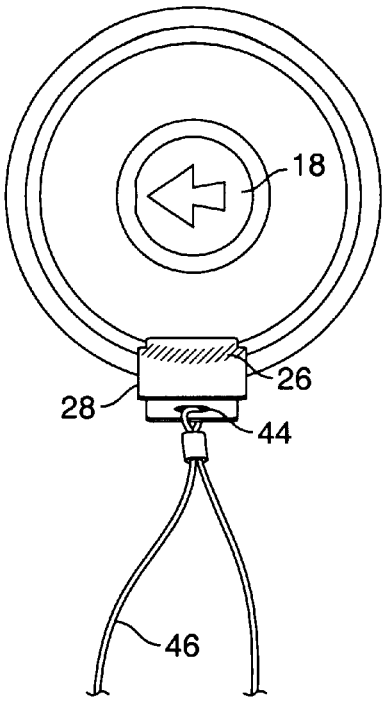
FIG. 8 is a top view of a spring clip attached to a lanyard clipped to the seal ring of a pressurized spray bottle having its finger operated spray knob attached.

FIG. 8 shows a top view of the same arrangement including knob 18 installed.

Figure 9:
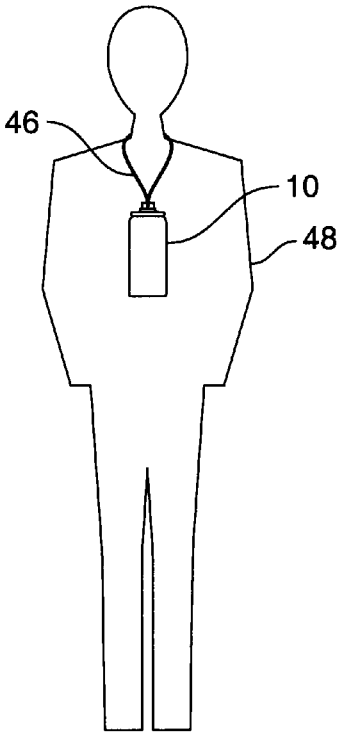
FIG. 9 is a diagram showing a user wearing a pressurized spray bottle attached to a lanyard about the user's neck.

FIG. 9 is a representation of how bottle 10 might be worn about the neck of a user 48.

Figure 10:
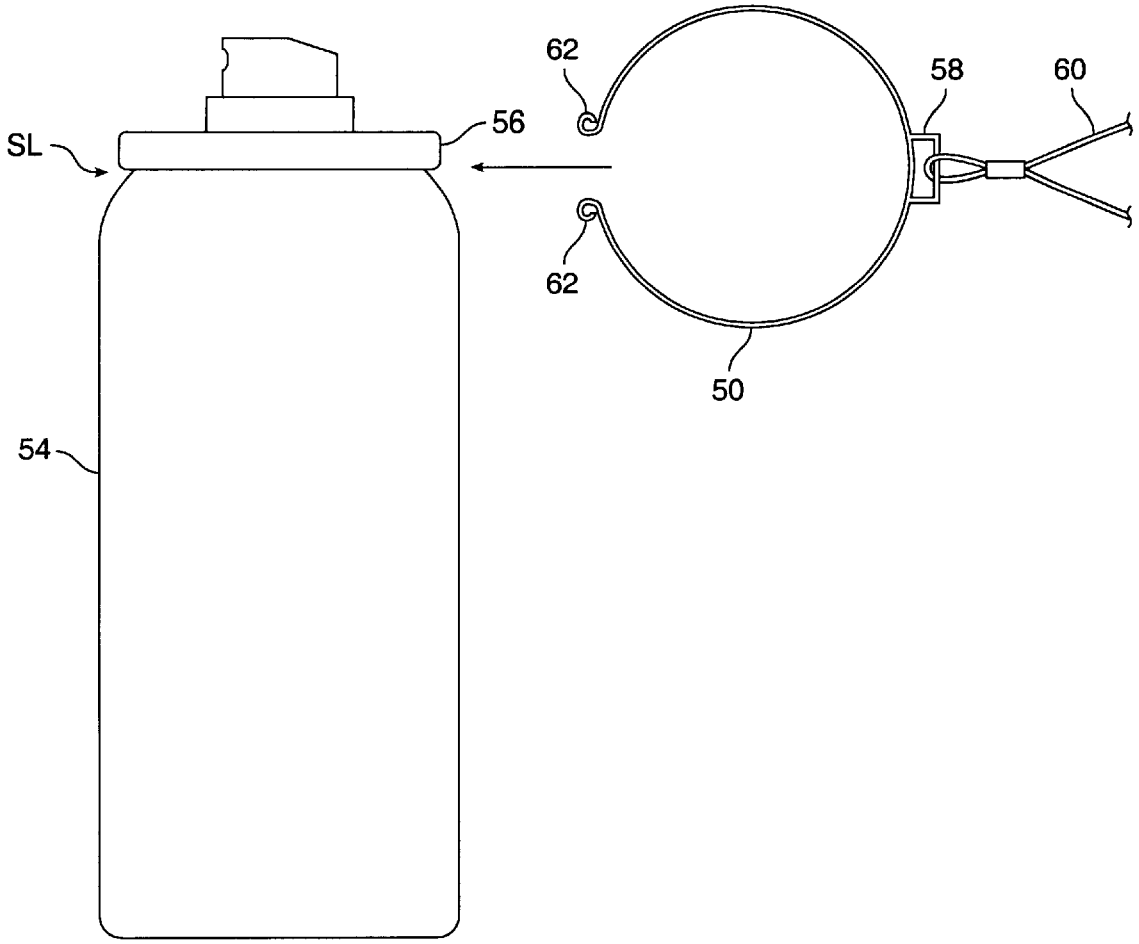
FIG. 10 is a front elevational diagram showing an alternative preferred embodiment of the present invention.
Figure 11:
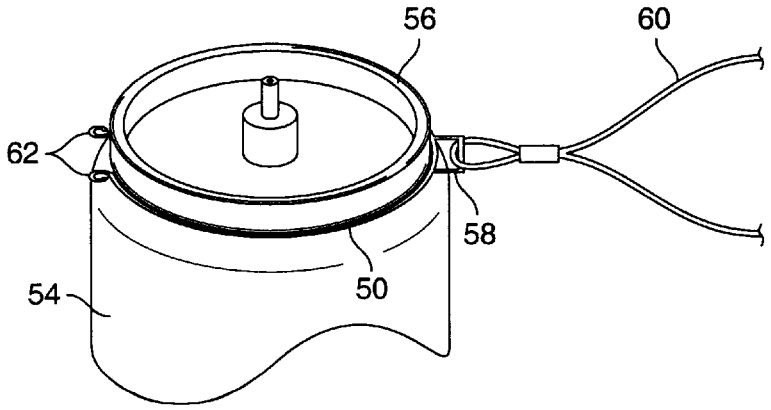
FIG. 11 is a front perspective diagram of the alternative preferred embodiment of FIG. 10.

Turning now to FIGS. 10 and 11, an alternative preferred embodiment of the present invention is shown. In this alternative preferred embodiment, a resilient spring band 50 is adapted to fit about the interface 52 between pressurized spray bottle 54 and sealing ring 56 is shown. Resilient clip 50 includes an attachment point 58 for a lanyard 60 which may be worn about some part of the body such as the neck, waist, or hand. Resilient clip 50 is shown attached to the interface between sealing ring 56 and pressurized spray bottle 54 at FIG. 11. Preferably knobs 62 are provided at the ends of resilient spring clip 50 so as to permit easy attachment and removal of spring clip 50 from pressurized spray bottle 54.

Figure 12:
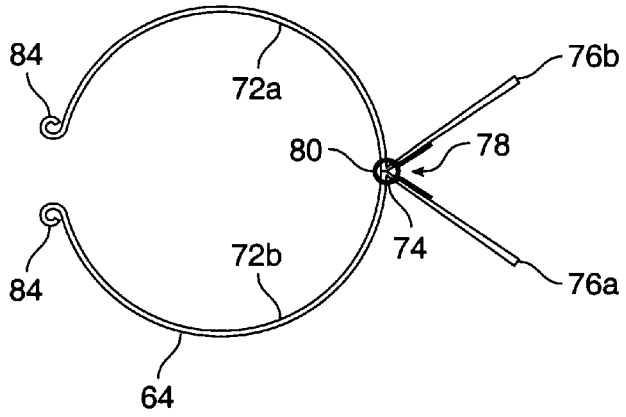
FIG. 12 is another alternative preferred embodiment of the present invention.
Figure 13:
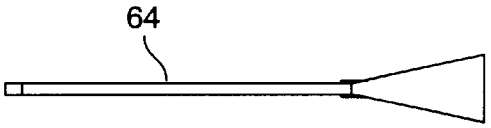
FIG. 13 is a side view of the clip of the alternative preferred embodiment of FIG. 12.
Figure 14:
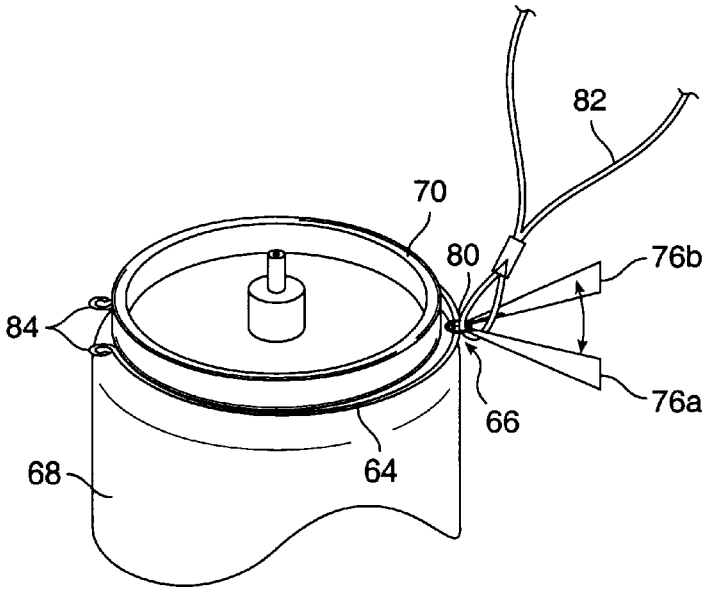
FIG. 14 is a front perspective view of the alternative preferred embodiment of FIG. 12 showing the removable clip attached to a pressurized spray bottle.

Turning now to FIGS. 12, 13 and 14, another alternative preferred embodiment of the present invention is shown. The difference here between the embodiment of FIGS. 12, 13 and 14 in the embodiment of FIGS. 10 and 11, is that a spring loaded pinch type pair of levers is provided to ease attachment and removal of the clip. Turning in more detail to the drawings, a clip 64 is provided for attachment to the interface 66 between the pressurized spray bottle 68 and its sealing ring 70. FIG. 12 shows a top view of attachment ring 64. Attachment ring 64 includes a pair of preferably resilient spring members 72*a* and 72*b* which are joined at the pivot point 74. Knobs 76*a* and 76*b* are respectively attached to members 72*a* and 72*b* and biased apart from one another by spring member 78. In this fashion, pressing knobs 76*a* and 76*b* together forces members 72*a* and 72*b* apart releasing clip 64 from pressurized spray bottle 68. An attachment point 80 is preferably provided for the attachment of lanyard 82 to clip 64. The attachment point may either be near pivot point 74, on one of knobs 76*a* and 76*b*, or at some other point on clip 64. As in the embodiment of FIGS. 10 and 11, knobs 84 may be provided to ease the attachment removal process and to prevent having any sharp ends which might cause injury.

Figure 15:
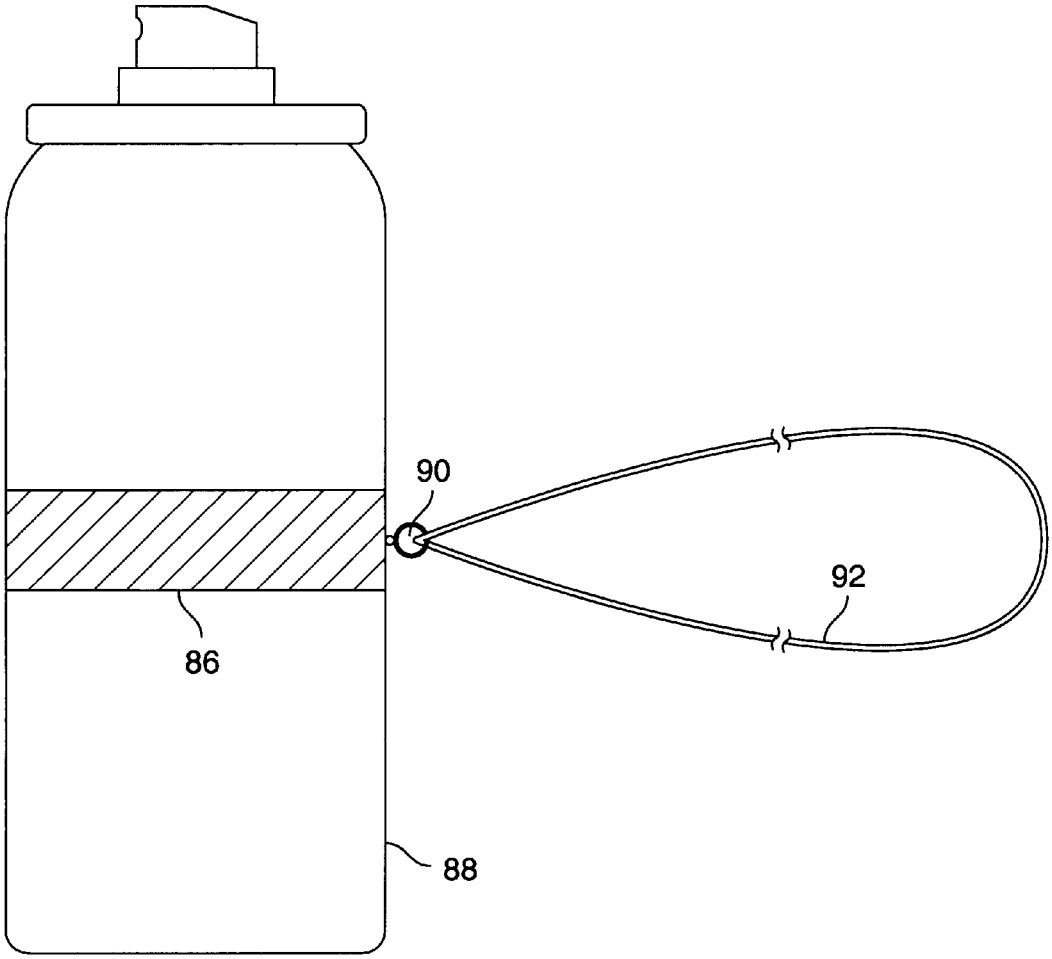
FIG. 15 is yet another alternative preferred embodiment of the present invention.

In yet another preferred embodiment of the present invention as shown in FIG. 15, a band 86 may include at its inner periphery either a high friction material such as rubber or an adhesive material so that the band may be attached in a relatively slip-free manner to the body of pressurized spray bottle 88. An attachment point 90 is provided so that a lanyard 92 may be attached for use as described above.

Figure 16:
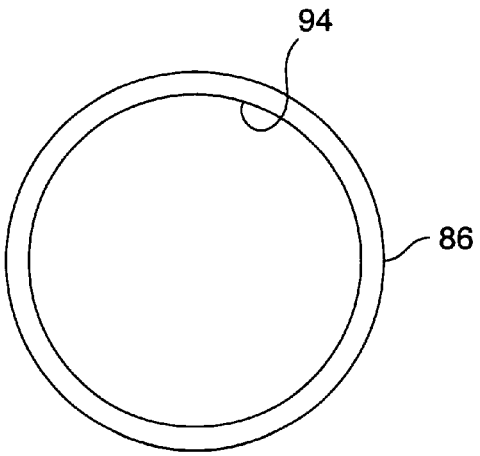
FIG. 16 is a top view of the band of the alternative preferred embodiment shown in FIG. 15.

Turning to FIG. 16, a top view of band 86 is shown. As stated before, band 86 may, at its inner periphery 94, have an adhesive material. The material may also be a high friction material such as a rubber material which would prevent band 86 from easily sliding off of pressurized spray bottle 88.

Alternative Embodiments.

Although illustrative presently preferred embodiments and applications of this invention are shown and described herein, many variations and modifications are possible which remain within the concept, scope, and spirit of the invention, and these variations would become clear to those of skill in the art after perusal of this application. This invention, therefore, is not to be limited except in the spirit of the appended claims.

What is claimed is:

1. A method of wearing a pressurized spray bottle comprising the steps of:

attaching a lanyard to a spring clip having opposing teeth;

clipping the spring clip around the seal ring of the pressurized spray bottle; and placing the lanyard around a part of the user.

2. A wearable spray bottle, comprising:

a pressurized spray bottle including a circular seal ring;

a spring clip having opposing teeth biased together clipped over said seal ring, said teeth fitting about said seal ring;

lanyard attaching means for attaching a lanyard to said spring clip; and a lanyard attached to said lanyard attaching means.

* * * * *